US007905291B2

(12) United States Patent
Kotsonis et al.

(10) Patent No.: US 7,905,291 B2
(45) Date of Patent: Mar. 15, 2011

(54) BOREHOLE CLEANING USING DOWNHOLE PUMPS

(75) Inventors: Spyro Kotsonis, Missouri, TX (US); Warren Zemlak, Moscow (RU); Eric Lavrut, Yokohama (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 30 days.

(21) Appl. No.: 12/299,050

(22) PCT Filed: Apr. 26, 2007

(86) PCT No.: PCT/EP2007/003679
§ 371 (c)(1),
(2), (4) Date: Feb. 20, 2009

(87) PCT Pub. No.: WO2007/128425
PCT Pub. Date: Nov. 15, 2007

(65) Prior Publication Data

US 2009/0173501 A1 Jul. 9, 2009

(30) Foreign Application Priority Data

May 3, 2006 (EP) ..... 06290733

(51) Int. Cl.
*E21B 37/00* (2006.01)

(52) U.S. Cl. ..... 166/311

(58) Field of Classification Search ..... 166/68, 166/311, 264, 100; 175/60
See application file for complete search history.

(56) References Cited

U.S. PATENT DOCUMENTS

| | | | | |
|---|---|---|---|---|
| 1,476,747 | A | 12/1923 | Wolever | |
| 2,330,336 | A | 9/1943 | Crites | |
| 2,916,091 | A | 12/1959 | Caudill | |
| 3,963,073 | A * | 6/1976 | Laval, Jr. | 166/105.1 |
| 4,619,323 | A | 10/1986 | Gidley | |
| 4,621,693 | A * | 11/1986 | Caldwell et al. | 166/311 |
| 4,694,901 | A * | 9/1987 | Skinner | 166/222 |
| 4,744,420 | A * | 5/1988 | Patterson et al. | 166/312 |
| 5,033,550 | A * | 7/1991 | Johnson et al. | 166/372 |
| 5,069,285 | A * | 12/1991 | Nuckols | 166/311 |

(Continued)

FOREIGN PATENT DOCUMENTS

GB 2340155 2/2000

(Continued)

OTHER PUBLICATIONS p. 247 Well Cementing, 2nd Edition, E. Nelson and D. Guillot editors, Schlumberger 2006.

(Continued)

*Primary Examiner* — Shane Bomar
*Assistant Examiner* — Blake Michener
(74) *Attorney, Agent, or Firm* — David Cate; Robin Nava; Jeffrey Griffin

(57) ABSTRACT

An apparatus for borehole cleaning comprises a tubular conveyance extending from the surface into a borehole to a region to be cleaned, a motor mounted at the end of the tubular conveyance that in use is introduced into the borehole, a pump connected to the motor and having a nozzle, and a power cable extending trough the tubular conveyance from the surface to provide power to the motor, The pump is arranged such that, when positioned in the borehole and operated by the motor, the pump withdraws material from the borehole through the nozzle and pumps it into the tubular conveyance to the surface.

2 Claims, 4 Drawing Sheets

U.S. PATENT DOCUMENTS

| | | | | |
|---|---|---|---|---|
| 5,209,293 | A * | 5/1993 | McNaughton et al. | 166/68.5 |
| 5,269,377 | A * | 12/1993 | Martin | 166/385 |
| 5,413,721 | A * | 5/1995 | Schmitt | 210/747 |
| 5,447,200 | A | 9/1995 | Dedora et al. | |
| 5,667,369 | A * | 9/1997 | Cholet | 417/448 |
| 5,906,242 | A * | 5/1999 | Bruewer et al. | 166/378 |
| 6,216,788 | B1 | 4/2001 | Wilson | |
| 6,220,347 | B1 * | 4/2001 | Head | 166/105.3 |
| 6,298,917 | B1 * | 10/2001 | Kobylinski et al. | 166/369 |
| 6,352,113 | B1 | 3/2002 | Neuroth | |
| 6,666,269 | B1 * | 12/2003 | Bangash et al. | 166/310 |
| 7,028,769 | B2 * | 4/2006 | Mullins | 166/177.3 |
| 7,360,998 | B2 * | 4/2008 | Burns | 417/53 |
| 7,396,216 | B2 * | 7/2008 | Blauch et al. | 417/423.3 |
| 2003/0198562 | A1 | 10/2003 | Blauch et al. | |

FOREIGN PATENT DOCUMENTS

| | | |
|---|---|---|
| GB | 2345932 | 7/2000 |

OTHER PUBLICATIONS p. 521-543 Well Cementing, 2nd Edition, E. Nelson and D. Guillot editors.

* cited by examiner

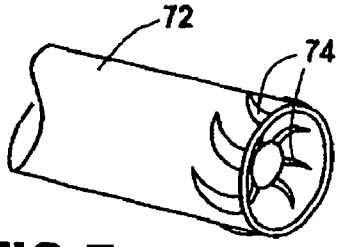
FIG.7
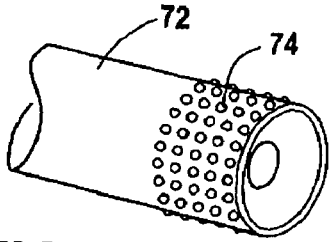
FIG.8
FIG.9
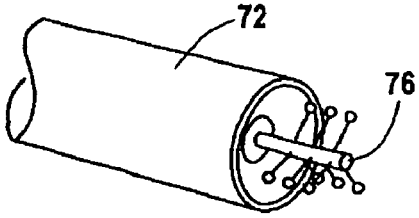
FIG.10
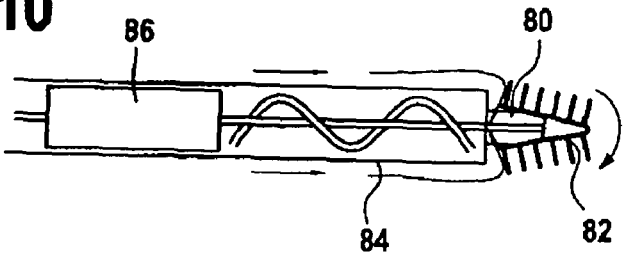
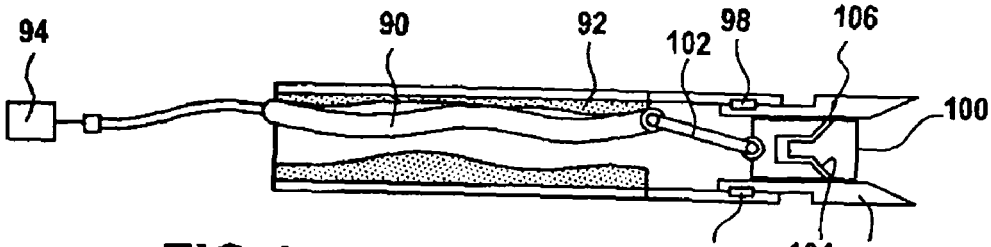
FIG.11

BOREHOLE CLEANING USING DOWNHOLE PUMPS

TECHNICAL FIELD

Embodiments of the invention relate to systems for borehole cleaning that allow removal of materials in a borehole preventing flow. In particular, embodiments of the invention relate to system for use in wells such as oil and gas wells.

BACKGROUND OF THE INVENTION

As oil and gas are extracted from producing wells, sand and heavy oils that have flowed through the perforations accumulate. These are too heavy to flow to the surface along with the usual fluids produced by the well at normal production rates, and tend to accumulate in low-lying areas as shown in FIGS. 1 and 2. Additionally, drilling muds used during the drilling process are generally heavier than the reservoir fluid, and tend to also segregate to low-lying areas of the well. Finally, proppant used during reservoir fracturing operations is not always completely removed. The accumulation problem in particularly severe where the trajectory of the well 10 is at or close to horizontal in the producing reservoir 12 and sumps 14 are present. Deposits 16 in these regions reduce the effective cross-section of the well 10 with a corresponding decrease in flow area 18 and therefore increase the pressure drop of the production fluids. In order to maintain or increase the production of such a well, it is necessary to remove this fill. Conventional methods of fill removal (or cleanout) involve high-pressure jetting through coiled tubing (CT) to mobilize the fill around the cleaning tool and sweep it to the surface by slowly pulling the CT up, the flow of jetting fluid and production fluid carrying the loosened fill to the surface. This high pressure mobilization jetting does increase the Bottom Hole Pressure (BHP) of the reservoir though, so it is only applicable to wells in formations that can sustain a full hydrostatic column (or foam column, in the case of foam clean-outs) and the increased pressure due to jetting. An example of one such technique is the PowerCLEAN service offered by Schlumberger.

In most well cleanout applications, the reservoir pressure is high enough, and the rock permeability low enough, to allow increase of pressure in the well while performing cleanout operations. In others, foam can be used to sweep the fill up. However there are still many wells that either cannot hold a foam column, or where foam use is restricted due to logistics reasons (e.g. procurement and disposal of N2 foam). In these situations, the only existing cleanout solution is a concentric coiled tubing (CCT) service to power a downhole jet pump. Using CCT implies a high use of power liquid to move the fill out and is limited in length by the weight of the coil-in-coil assembly.

Examples of CCT techniques can be found in U.S. Pat. No. 2,548,616, U.S. Pat. No. 5,033,545, U.S. Pat. No. 5,269,384, U.S. Pat. No. 5,375,669, U.S. Pat. No. 6,263,984, U.S. Pat. No. 6,015,015, U.S. Pat. No. 6,497,290, U.S. Pat. No. 6,640,897, U.S. Pat. No. 6,712,150, U.S. Pat. No. 5,503,014, and WO 2005085580 A.

Embodiments of the invention aim to provide an alternative to CCT techniques while also extending the depths at which clean-out operations can be performed. An embodiment of the invention is based on the use of a downhole pump that is powered by a cable running inside the tubing conveyance.

SUMMARY OF THE INVENTION

One aspect of the invention provides apparatus for borehole cleaning, comprising:

- a tubular conveyance for extending from the surface into a borehole to a region to be cleaned;
- a motor mounted at the end of the tubular conveyance that in use is introduced into the borehole;
- a pump connected to the motor and having a nozzle;
- a power cable extending trough the tubular conveyance from the surface to provide power to the motor;

the pump being arranged such that, when positioned in the borehole and operated by the motor, the pump withdraws material from the borehole through the nozzle and pumps it into the tubular conveyance to the surface.

A second motor and pump can be located in the tubular conveyance above the pump so as to provide extra lift to the material to be removed from the well. Additional 'booster' pumps can be added in this way up to the power limit of the wireline cable.

A gas supply line can extend at least part way along the inside of the tubular conveyance and be arranged to introduce gas into the material-laden flow in the tubular conveyance above the pump.

The apparatus can further comprise a filter between the nozzle and the pump to prevent large particulate material passing into the pump from the borehole. Preferably, the filter removes material of greater than 1 mm from the flow.

It is particularly preferred that the apparatus comprises means to move the nozzle when the pump is operated downhole. Movement of the nozzle can be used to further mobilize the fill and suspend it in the fluids in the well. The means can rotate and/or reciprocate the nozzle. A separate motor can be provided to enable this mobilizing movement. Alternatively, a mechanical connection to a rotor in the pump can be provided for this purpose.

Features can be provided on the outside and/or inside of the nozzle to accelerate the flow of material when operated downhole to aid in movement of solids.

The tubular conveyance is preferably coiled tubing.

Another aspect of the invention provides a method of cleaning a well using an apparatus as defined above, comprising:

- extending the tubular conveyance into the borehole so as to position the nozzle in a region to be cleaned;
- operating the pump so as to draw fluid and solid material from the region and pump them to the surface through the tubular conveyance.

The method can further comprise injecting gas into the materials in the tubular conveyance to create foam of reduced density to assist pumping of the materials to the surface.

Preferably, the solid materials are agitated downhole to improve removal by the pump.

The nozzle can be rotated or reciprocated while operating the pump.

Alternately advancing and withdrawing the tubular conveyance over a limited distance can be used to reciprocate the downhole end of the conveyance in the region to be cleaned.

In one embodiment, the tubular conveyance is extended until the pump is located at the bottom of a region to be cleaned and progressively withdrawing the conveyance to move the pump upwards through the region as the pump is operated. In another, the tubular conveyance is extended until the pump is positioned at the top of a region to be cleaned and progressively advancing the conveyance to move the pump downwards through the region as the pump is operated.

BRIEF DESCRIPTION OF THE DRAWINGS

FIGS. 7-11 show embodiments of features that can be added to a nozzle to improve fill mobilisation.

DETAILED DESCRIPTION OF THE INVENTION

Figure 1:
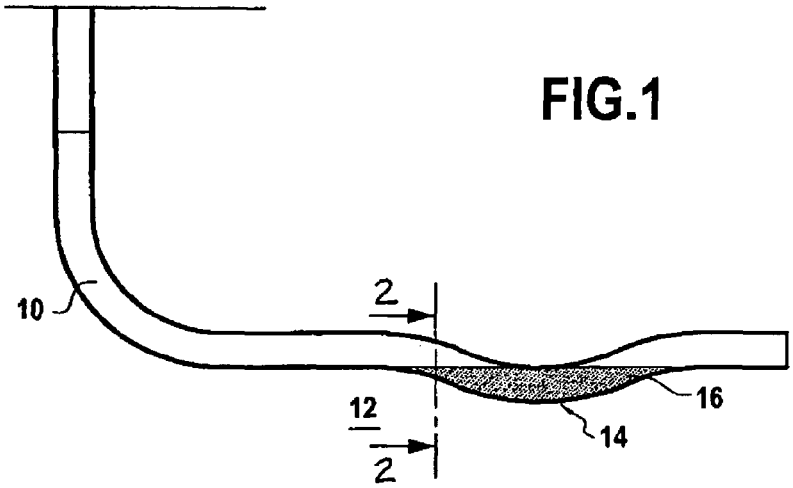
FIG. 1 shows a schematic view of a well in which the invention can be used.
Figure 2:
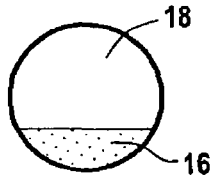
FIG. 2 shows a cross-section through the well on line 2-2 of FIG. 1.
Figure 3:
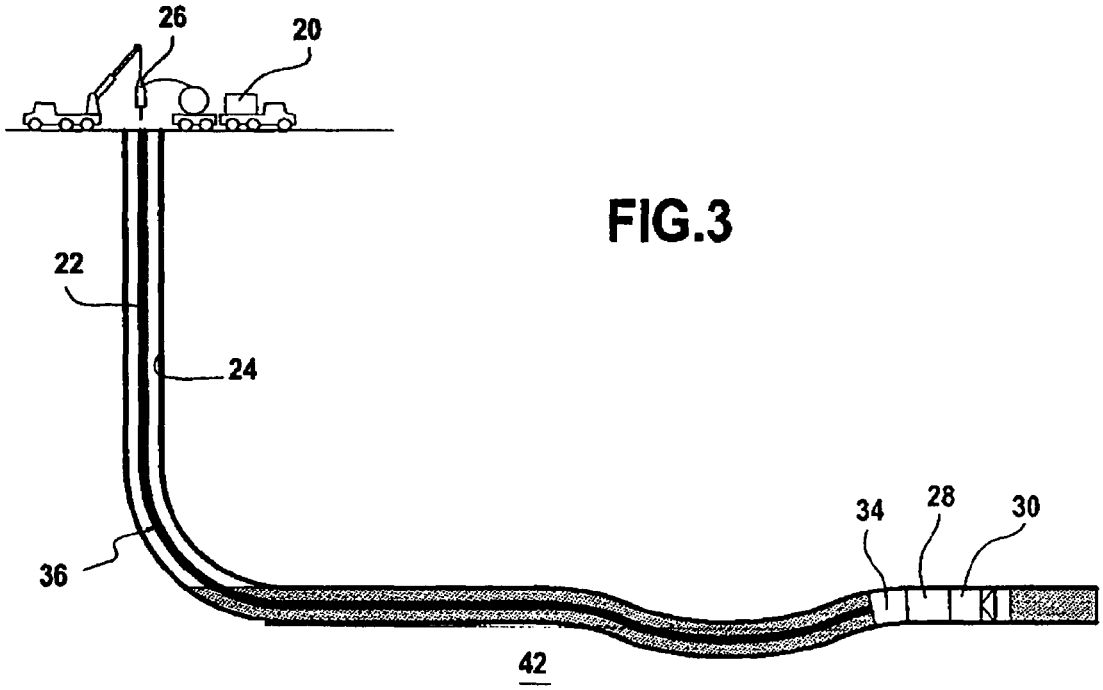
FIG. 3 shows a schematic view of a system according to the invention deployed in a well.
Figure 4:
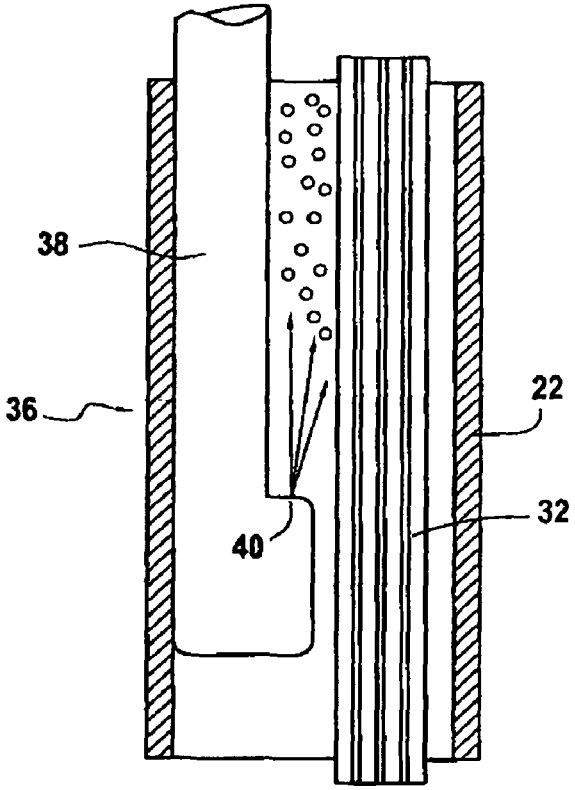
FIG. 4 shows a detailed view of part of the system of FIG. 3.

FIG. 3 shows the use of a system according to an embodiment of the invention in a well of the type shown in FIGS. 1 and 2. The system includes a CT surface system 20 that reels a coiled tubing 22 into the well 24 through surface pressure control equipment 26. An electrically powered motor 28 and pump 30 are located at the end of the CT 22. A power cable 32 (see FIG. 4) runs from the surface to the motor 28 through the CT 22 for protection. The CT 22 also acts as a conduit for fluid/fill mixture removal. The pump 30 is configured to flow in the 'reverse' sense, sucking from the lower end and moving the fluid and fill solids upwards through the pump 30 itself and through the CT 22 towards the surface. The CT insulates the well from any pressure increase caused by the pump as it pumps fluid to the surface so avoiding damage to the formation. This can be particularly important in Low BHP reservoirs that can easily be damaged by relatively small increases in wellbore pressure above the in-situ reservoir pressure.

The power required to overcome the vertical height (TVD) hydrostatic pressure can be relatively large compared to the power usually available for downhole tools powered via an electric cable (e.g. wireline tools). Since 3-9 kW of electrical power is typically available to power the pump with current wireline technology, for a flow rate of 10 gpm (considered as suitable for this type of application), flow can only be assured for the first few kilometers (depending on CT size and fluid/fill density and viscosity). Therefore, an additional boost may be required to move the fluid mixture to the surface where it can be disposed of or separated.

One method of boosting the hydraulic power is to add a second pump/motor combination 34 in series with the first pump of an embodiment of this invention; either right next to it, or further up along the CT 22. Another method of using dual pumps to carry cuttings during drilling has been disclosed in GB2416550A.

Another preferred method of assisting the fluid to reach the surface is to run a pilot line 38 partway along the CT (to point 36) to inject $N_2$ gas via a nozzle 40. The length of this pilot line 38 can be determined a priori by knowing the geometry of the well, as it is preferable to inject the gas into the CT above the horizontal section. This will decrease the hydrostatic weight of the fluid above the injection point as the gas moves up, and will also avoid the risk of creating a gas 'plug' if the gas were injected lower (if the gas is injected in the horizontal section 42, then the pump 30 will need to push the fluid and the gas up the CT 22, thus increasing the system losses and causing a 'slug' flow condition where gas and fluid 'slugs' alternatively flow to the surface; leading to a less efficient carrying capacity system).

In the case of the sand plug where it is not possible to force the end of the CT 22 through merely by pushing the CT from the surface, pump operation can start from the top of the plug and the CT 22 slowly be run-in-hole to pump a mixture of well fluid and sand.

A mechanical sand mobilization means may be beneficial under this situation so as to fluidize the sand and make it easier to flow through the pump and up the CT. These are described below in more detail in relation to FIGS. 7-9.

In the case of leftover drilling muds or heavy oils, then the apparatus can be run to the bottom of the well and pulled out of hole while the pump is operated. This will use the heavy fluids behind (i.e. above) the apparatus to act as a temporary dynamic seal and the removal of fluid from the lower part of the well can create a localized drawdown at that level. If the upper fluid is not viscous enough, then the drawdown will not materialize locally, but rather from a reduction of the well fluid level; in turn lowering the hydrostatic pressure over the entire well. If this is not desired, water or other appropriate fluid can be injected at the well head to compensate for the fluid removal through the CT.

Figure 5:
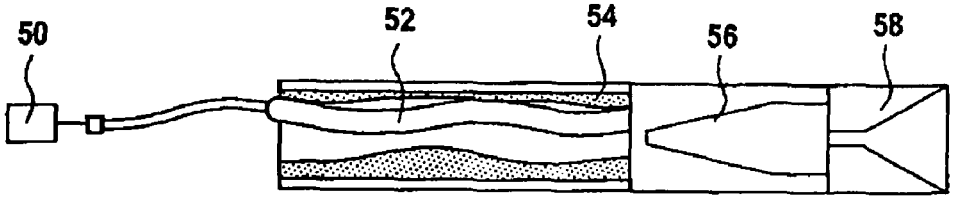
FIG. 5 shows an embodiment of the invention for handling larger particulate materials in the fill.

During a clean-out operation, the apparatus may encounter pebbles and larger particles that have gravitated to the low side of the well and are mixed with the fill. One particular embodiment of the invention for use in such circumstances is shown in FIG. 5. In this embodiment, the pump motor 50 is connected to the rotor 52 of a Moineau-type pump having an elastomer stator 54. A junk basket 56 is added between the pump nozzle 58 and the pump 52, 54 and can be used to retain the larger particles that might otherwise harm the pump or that cannot be effectively transported to the surface while still allowing through the finer fill encountered in the well. A typical pass-through particle diameter can be <1 mm.

The effectiveness of the mobilization of the fill can be greatly enhanced if a mechanical mixing of some sort takes place. There are various techniques that can be used for creating mechanical mobilization of fine particles and sand.

The surface injector can be used to stroke the CT backwards and forwards over a predetermined length (e.g. 1 foot (300 mm) as the nozzle is moved through the fill.)

Figure 6:
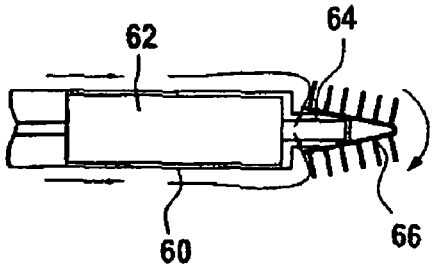
FIG. 6 shows an embodiment of the invention for fill mobilisation.

A second motor can be provided at the tip of the pump tool to rotate the pump nozzle as is shown in FIG. 6. In this embodiment, an electric motor 60 is positioned in the CT 62 near the nozzle 64. The nozzle 64 is provided with a wire brush or mill 66. Operation of the motor 60 rotates the nozzle 64 and brush or mill 66 to mobilise the fill.

Features can be added at or around the pump nozzle to mechanically agitate the fill as the nozzle is rotated. FIGS. 7-11 show examples of such features. In FIG. 7, blades/scallops and threads 70 are formed around the outside and inside respectively of the nozzle 72, serving to accelerate the fill as the nozzle 72 is rotated. In FIG. 8, hard buttons 74 are provided around the nozzle 72 for the same purpose. In FIG. 9, a brush 76 is connected to the pump rotor (not shown) and projects through the nozzle 72 into the fill. As the rotor rotates, the brush 76 rotates to mobilise the fill. These and/or other features can be used alone or in combination to improve mobilisation of the fill.

In another embodiment, pump hydraulic power can be used to create a slow reciprocating motion of the nozzle (via a low power turbine for example), that can assist mobilisation of the fill using features such as those described above.

FIG. 10 shows and embodiment in which the nozzle 80 (carrying a brush/mill 82 similar to that shown in FIG. 6) is linked to the lower part of the pump rotor 84 (for a Moineau-type positive displacement pump, for example) that is driven by an electric motor 86. In use, some of the power of the motor 86 is used to rotate the nozzle and brush/mill 82, the remaining power being used to pump the mobilised fill.

FIG. 11 shows one particular mechanism for converting the rotational motion of a pump rotor into reciprocating motion at the nozzle. In this embodiment, a Moineau-type pump having a rotor 90 and a stator 92, the rotor 90 is driven by a motor 94. The stator housing is extended at its lower end and carries a nozzle 96 mounted so as to be able to slide therein. Keys 98 positioned between the stator 92 and nozzle 96 prevent relative rotation of the stator and nozzle while allowing relative axial sliding. A rotatable J-slot holder 100 is positioned inside the nozzle 96 and connected to the pump rotor 90 by means of a drive shaft 102. A J-slot 104 is provided in the outer surface of the holder 100. A peg 106 projects from the inner surface of the nozzle 96 so as to engage in the J-slot 104. As the holder 100 rotates with the rotor 90, the peg 106 is forced to follow the path of the J-slot 104, in turn causing the nozzle to move axially with respect to the stator 92 (the J-slot 104 and peg 106 act in the manner of a cam and cam follower to convert rotary motion into reciprocating motion). Depending on the particular design of the rotor and stator, various mechanisms can be used to provide the rotary drive to the nozzle. These can include simple drive shafts, shafts connected by universal joints, mutation disks and other such devices.

The limitation of how far the pump could be pushed in the well is usually the helical lockup of the CT in a deviated well. One way of circumventing this limitation is to combine an electric borehole tractor to pull the pump to depth, and then disengage and deactivate it to allow pumping while pulling the CT and pump back towards the surface. Hydraulic tractors can also be used when flowing in 'standard' (i.e. down the CT) circulation. However, their flow requirements can tend to increase BHP, which may be undesirable in very low pressure reservoir conditions.

Figure 12:
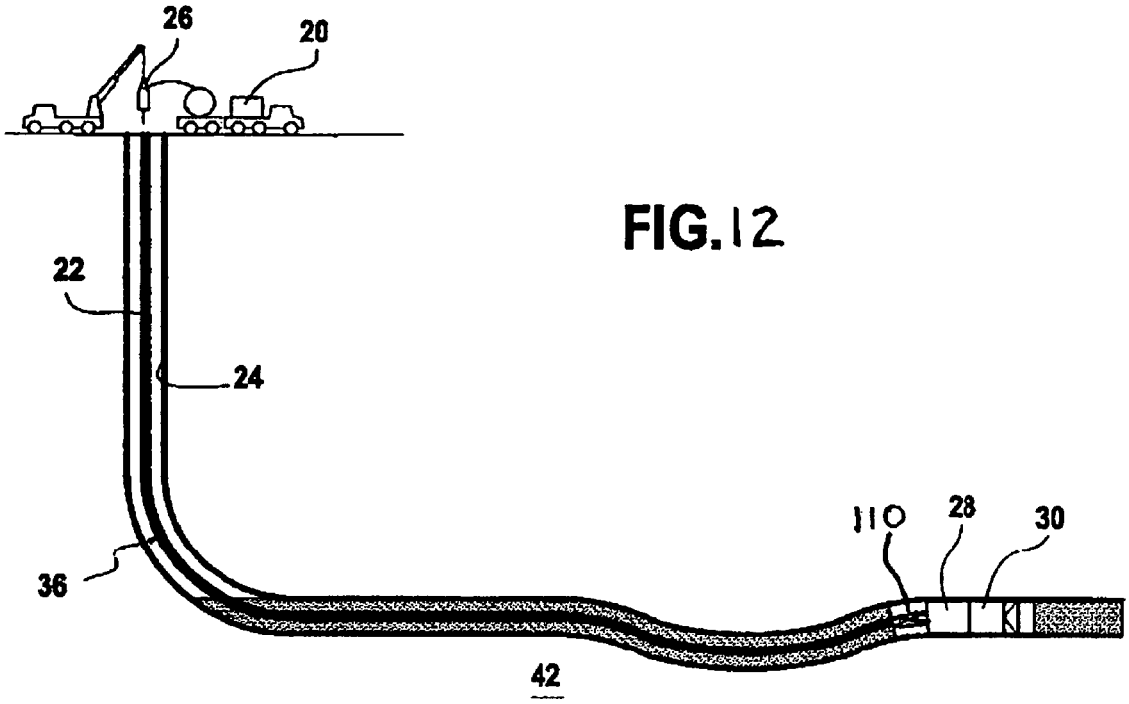
FIG. 12 shows an embodiment of the system comprising a flow-diverter.

The pump can also contain a flow-diverter 110 above it, best seen in FIG. 12, that may be commanded from the surface via optical or electrical means, that would allow opening ports to the annulus to flow through the CT in cases when well control or CT cleaning is required. Once the CT has been cleaned, or any obstructions have been removed, the flow-diverter can close the ports and normal 'reverse' circulation can resume.

Even without the flow-diverter described above, flowing in the 'standard' direction from the surface can also be used to clean the filter of accumulated pebbles by ejecting them further up the wellbore and then moving the tool back down to the fill and proceeding with the clean-out operation.

It will be appreciated that the various techniques described above can be combined to give the described advantages. Other changes can be made while staying within the scope of the invention.

The invention claimed is:

1. A method of cleaning a well, comprising:

providing an apparatus, comprising a tubular conveyance for extending from the surface into a borehole to a region to be cleaned;

a motor mounted at the end of the tubular conveyance that in use is introduced into the borehole;

a pump connected to the motor and having a nozzle; and a power cable extending through the tubular conveyance from the surface to provide power to the motor;

the pump being arranged such that, when positioned in the borehole and operated by the motor, the pump withdraws material from the borehole through the nozzle and pumps it into the tubular conveyance to the surface;

extending the tubular conveyance into the borehole so as to position the nozzle in a region to be cleaned;

operating the pump so as to draw fluid and solid material from the region and pump them to the surface through the tubular conveyance; and one of rotating and reciprocating the nozzle while operating the pump.

2. A method of cleaning a well, comprising:

providing an apparatus, comprising a tubular conveyance for extending from the surface into a borehole to a region to be cleaned;

a motor mounted at the end of the tubular conveyance that in use is introduced into the borehole;

a pump connected to the motor and having a nozzle, the pump being arranged such that, when positioned in the borehole and operated by the motor, the pump withdraws material from the borehole through the nozzle and pumps it into the tubular conveyance to the surface;

a power cable extending through the tubular conveyance from the surface to provide power to the motor; and a flow-diverter above the pump that opens ports to the annulus on command and allow high-volume circulation from the surface through the conveyance means to control the well pressure or perform other operations requiring high flow rates;

extending the tubular conveyance into the borehole so as to position the nozzle in a region to be cleaned; and operating the pump so as to draw fluid and solid material from the region and pump them to the surface through the tubular conveyance.

* * * * *